US008753168B2

(12) United States Patent
Kessler

(10) Patent No.: US 8,753,168 B2
(45) Date of Patent: Jun. 17, 2014

(54) PINWHEEL WITH LIGHTUP ELECTRONIC HEAD

(75) Inventor: Brian Kessler, Los Angeles, CA (US)

(73) Assignee: Maui Toys, Inc, Los Angeles, CA (US)

( * ) Notice: Subject to any disclaimer, the term of this patent is extended or adjusted under 35 U.S.C. 154(b) by 260 days.

(21) Appl. No.: 13/426,152

(22) Filed: Mar. 21, 2012

(65) Prior Publication Data

US 2013/0252507 A1 Sep. 26, 2013

(51) Int. Cl.
*A63H 33/40* (2006.01)

(52) U.S. Cl.
USPC ..... 446/217

(58) Field of Classification Search
USPC ..... 446/217, 218, 219
See application file for complete search history.

(56) References Cited

U.S. PATENT DOCUMENTS

| | | | | |
|---|---|---|---|---|
| 2,857,507 | A | 10/1958 | Stec | |
| 4,108,535 | A * | 8/1978 | Slaughter | 359/525 |
| 5,092,809 | A | 3/1992 | Kessler | |
| 6,530,816 | B1 * | 3/2003 | Chiu | 446/217 |
| 6,575,585 | B2 * | 6/2003 | Nelson et al. | 362/35 |
| 6,769,951 | B2 * | 8/2004 | Collier | 446/218 |
| 6,789,911 | B2 * | 9/2004 | Nelson et al. | 362/35 |
| 7,278,616 | B2 * | 10/2007 | Kahan | 248/214 |
| 8,046,941 | B2 * | 11/2011 | Schnuckle | 40/324 |

* cited by examiner

*Primary Examiner* — Kurt Fernstrom
(74) *Attorney, Agent, or Firm* — Browdy and Neimark, PLLC

(57) ABSTRACT

A pinwheel toy having a handle, a shaft engaged to the handle and blades which spin about the shaft in response to wind pressure, has blades formed of holographic film having a three-dimensional appearance of a hologram, an electronic module within a capsule, and having a plurality of lights facing backward toward front faces of the blades, the electronic module being engaged with the shaft, and an impact switch engaged by tapping a front face of the capsule.

10 Claims, 3 Drawing Sheets

PINWHEEL WITH LIGHTUP ELECTRONIC HEAD

BACKGROUND OF THE INVENTION

1. Field of the Invention

The invention relates to pinwheel toys and more particularly to a pinwheel toy presenting an unusual visual display produced by an electronic head with flashing lights which reflect off the pinwheel blades made from holographic film or the like.

2. Prior Art

Pinwheel toys are well known in the prior art. They usually consist of one or more shaped pieces of plastic, paper or the like, cut from sheet material to define a plurality of blades with a central orifice through which a pin or shaft is passed when the pinwheel is mounted for rotation on the pin or shaft. The pin or shaft is usually mounted perpendicular to another elongated shaft which is used as a handle. Wind blowing against the blades of the pinwheel causes rotation of the blades about the pin or shaft like a propeller, creating an effect enjoyed particularly by children.

Attempts are often made by pinwheel makers to create impressive visual displays with the rotation of the pinwheel. For example, U.S. Pat. No. 2,857,507 discloses an electric lawn ornament having multicolored lights behind a pinwheel to produce an impressive visual display while spinning. Some pinwheels are also made to be visually impressive while not rotating such as by having various patterns imprinting on the blades. A prior pinwheel was known and was sold commercially, having lights on "wings" facing the pinwheel.

Plastic toys of various types containing dyes or pigments, even fluorescent, phosphorescent and dayglow dyes or pigments, are also known.

SUMMARY OF THE INVENTION

It is the object of the present invention to provide an improved pinwheel having an amusing and exciting display both when spinning and when not spinning.

It is another object of the present invention to provide a pinwheel having blades the appearance of which are accentuated by flashing lights when spinning.

The above objects are obtained in the present invention by producing the pinwheel blades of a decorative and preferably holographic film and providing an electronic head with flashing lights which can be easily and simply activated to reflect off the front surface of the pinwheel blades to provide a changing display when spinning.

BRIEF DESCRIPTION OF THE DRAWINGS

The above and other objects and the nature and advantages of the present invention will become apparent, and the present invention will be more clearly understood from the following detailed description taken in conjunction with the accompanying drawings, in which.

DETAILED DESCRIPTION OF THE PREFERRED EMBODIMENTS

Figure 1:
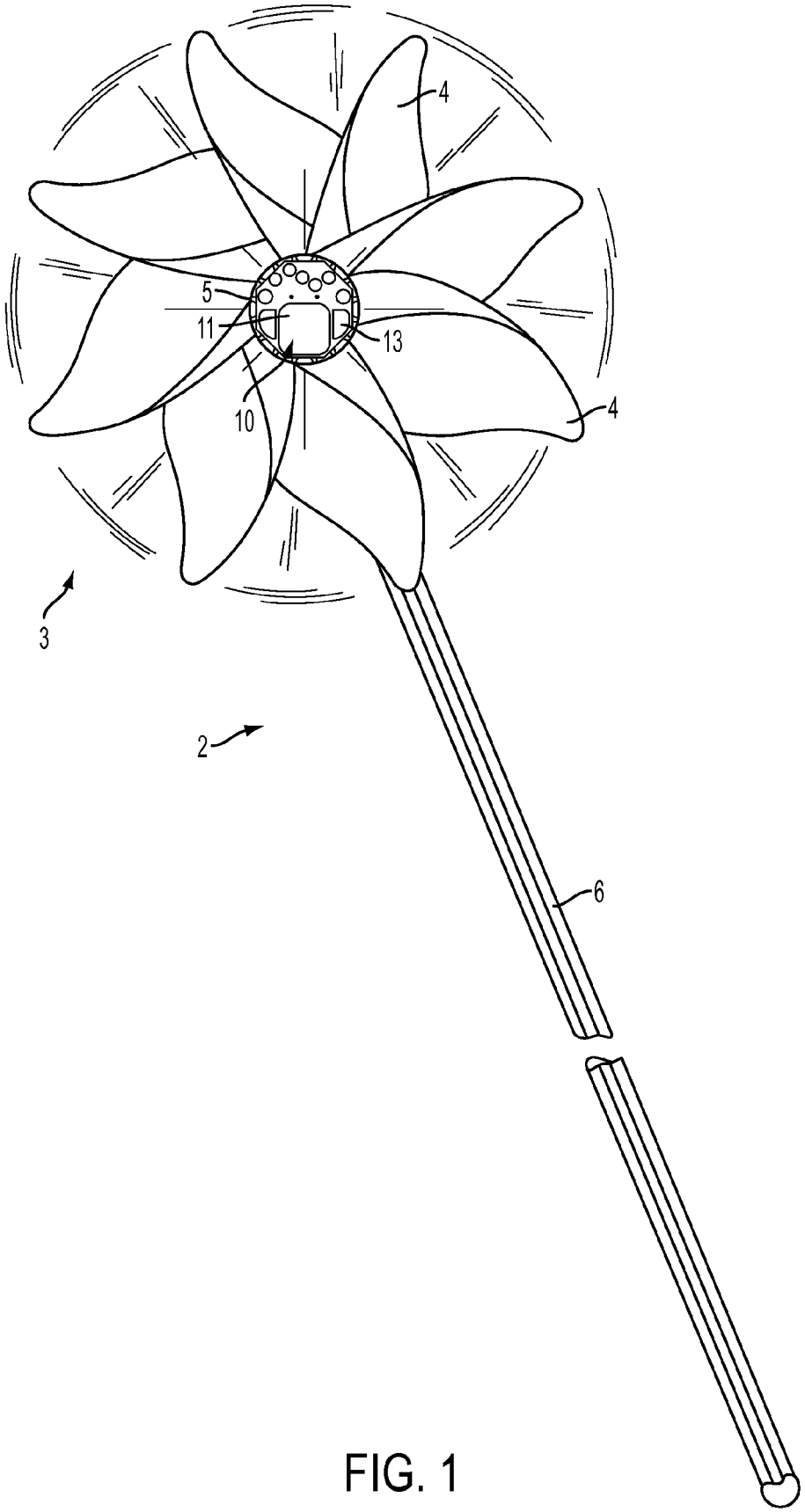
FIG. 1, is a front view of an embodiment of a pinwheel toy in accordance with the present invention.
Figure 2:
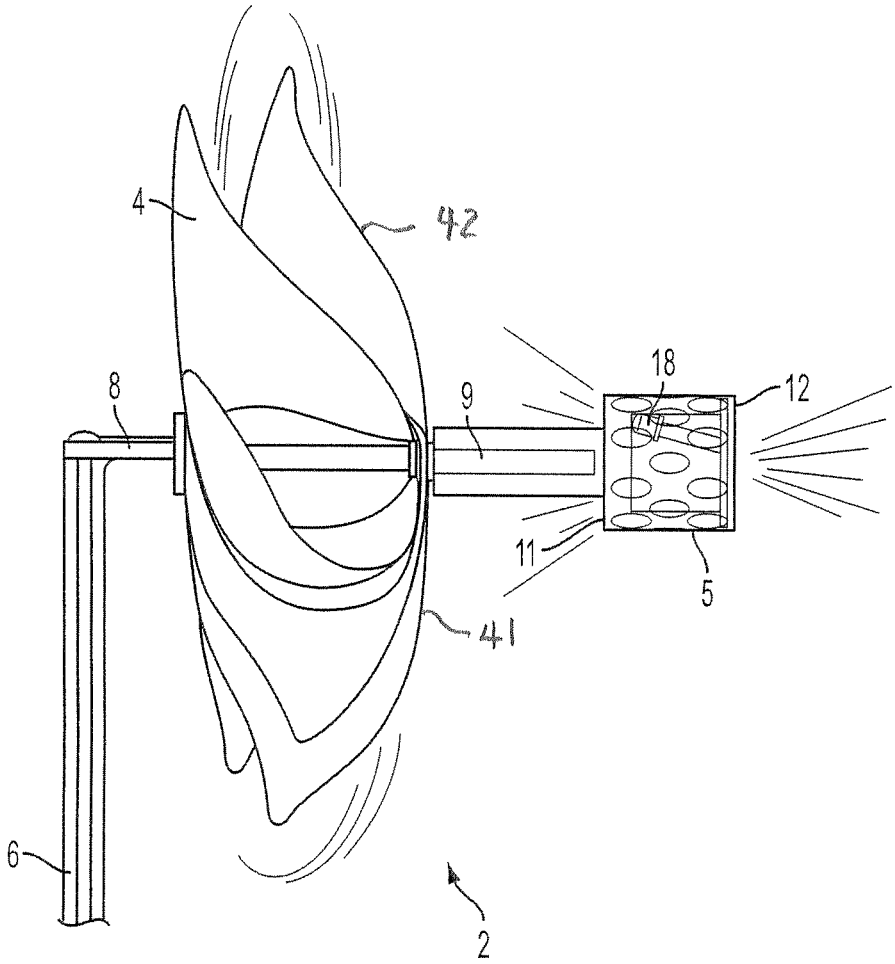
FIG. 2, is a side elevation view of the pinwheel toy head of FIG. 1.
Figure 3:
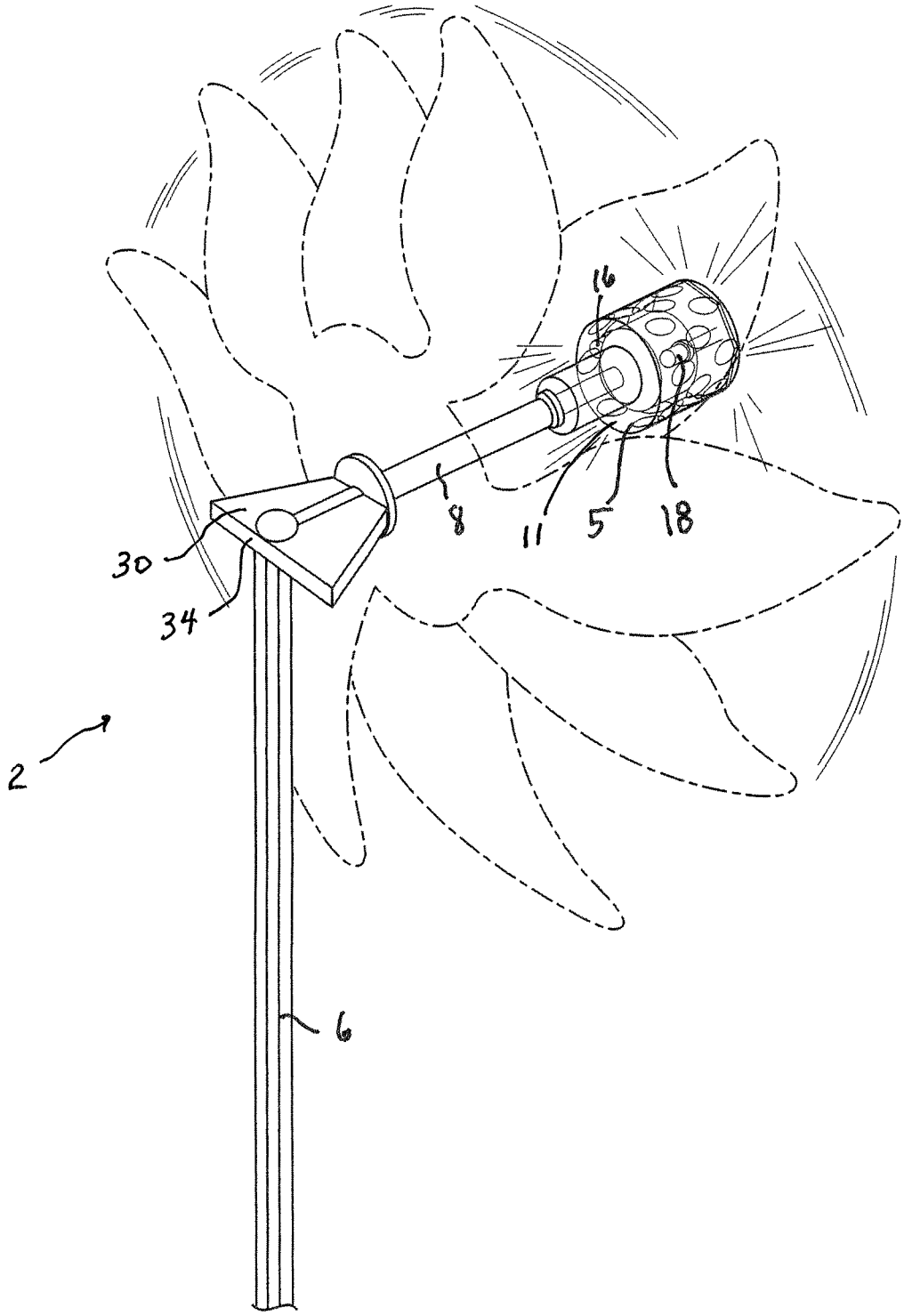
FIG. 3, is a perspective view from the backside of the pinwheel toy of FIG. 1 with its blades shown in phantom lines.

Referring to FIGS. 1-3, a pinwheel toy (2) according to the present invention is disclosed having a handle (6), head (3) with blades (4) and a pin or shaft (8) about which the blades (4) are adapted to rotate. Except for the shape of the blades (4), the precise construction of the pinwheel (2) structure is not part of the present invention, and such a pinwheel may take any operative form.

One important feature of the pinwheel of the present invention is the use of decorative and preferably holographic film to produce the blades (4) thereby giving the blades (4) an attractive and preferably three-dimensional appearance typical of holograms.

Engaged to the end (9) of shaft (8) is an electronic module (10) containing lights, preferable lighted electronic diodes (LEDs), desirably driven by batteries (13), the module (10) having a circuit, preferably a circuit board or PCB (11) and timer chip within the module (10), all desirably within a cylindrical capsule (5) coaxial with the shaft (8). Two on-off buttons may optionally be provided, but preferably the lights are turned on by an impact switch as part of the module (10) within the capsule (5), simply by tapping the front end (12) of the capsule (5). The timer, part of the circuit, turns the lights off after a predetermined time, e.g. 8-15 seconds.

At least one, and preferably at least two different LEDs (16, 18) are provided within the capsule (5) and which face backwards towards blades (4) and handle (6). At least two different LEDs (16, 18) are preferred because each LED may be provided to emit a different color, e.g. blue and red, although other different colors may be provided, and more than two LEDs may be provided. The circuit desirably provides that the lights flash alternatively, first one color, then another color, with preferably two colors not flashing at the same time.

In a preferred embodiment, the LED lights (16,18) are tilted at an angle of about 12° to 20°, preferably 15°, from being parallel to the shaft (8). Such slight degree of tilt enhances the visual effect of the light reflecting off the blades (4). In addition, the LED lights are spaced from the pinwheel blades by 0.2 to 1.5 inches, preferably about 0.55 inches, so that the light is projected in a wider circle off the blades (4), and not just off the central part of the blades.

As shown in the figures, the capsule (5) is desirably of a circular-cylindrical configuration. The LEDs (16, 18) are desirably arranged, as noted above, to point in a direction of about 12° to 20° from the shaft (9). As indicated above, the capsule has a rearwardly facing wall, best shown in FIG. 3, through which the light from the LEDs flash. For purposes of simplicity, the entire capsule (5) is made of a clear or translucent plastic material, although it is only essential that the back face (11) be sufficiently clear or transparent enough for the LED light to pass therethrough onto the blades (4) of the pinwheel.

As best shown in FIG. 2, the blades (4) of the pinwheel (2) are provided with a front surface, facing the flashing lights of the LEDs, which is relatively flat for about half the total width of the pinwheel. For example, considering the pinwheel as illustrated in FIG. 2, the front face (41), unlike most pinwheels, is relatively flat and does not begin to bend away to the curved area (42) until each of the blades (4) has reached approximately two-fifths to three-fifths the distance of each blade from the center at the shaft (8) to the outer tip of each blade. The purpose in making the blades flatter at the front end or edge (41) facing toward the LEDs is to provide a greater area of contact of the LED light against the rotating blades (4) than would be provided by usually shaped pinwheel blades. For example, in one pinwheel example having a width from blade tip to a blade tip at a position 180° from the first blade tip, the width of the flat area (41) is approximately 3.5 inches.

When the front face of the capsule (5) is tapped, e.g. against a surface, the internal impact switch is engaged and the LEDs (16,18) alternatively flash toward the pinwheel blades (4), on and off, and reflect light, preferably alternatively colored lights, off at least the front surfaces (41) of the blades (4) to give an exciting appearance as the holographic film blades spin around the pin or shaft (8).

In order to protect the electronic module (10) and blades (4) from damage when the pinwheel (2) is at rest on a surface, a stabilizing element (30) is integrally engaged to the end (32) of the shaft (8) so as to receive the end of handle (6). The flat edge (34) of the stabilizing element (30) acts holds shaft (8) perpendicular to the surface on which the pinwheel rests to maintain the module (10) and blades (4) out of contact with such surface.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. In a pinwheel toy of the type having a handle, a shaft engaged to the handle and blades which spin about the shaft in response to wind pressure, the improvement wherein the blades are formed of holographic film having a three-dimensional appearance of a hologram, and comprising an electronic module within a capsule, and having a plurality of lights facing backward toward front faces of the blades, said electronic module being engaged with the shaft, and an impact switch.

2. The pinwheel toy according to claim 1, wherein there are at least two said lights.

3. The pinwheel toy according to claim 1, wherein a stabilizing element is fixed to a top end of the handle, the stabilizing element having a straight edge perpendicular to the axis of the handle capable of flashing different colors alternatively.

4. The pinwheel toy according to claim 1, wherein the lights are controlled by the electronic module to flash alternatively.

5. The pinwheel toy according to claim 1, wherein the electronic module comprises batteries.

6. The pinwheel according to claim 1, wherein the electronic module comprises a timer to turn off the lights after a predetermined time.

7. The pinwheel toy of claim 2, wherein the lights are LED's.

8. The pinwheel toy of claim 1, wherein the capsule within which the electronic module is encased is cylindrical.

9. The pinwheel of claim 1, wherein the lights are inclined from the shaft by an angle of about 12° to 20°.

10. The pinwheel of claim 1, wherein the blades have a flat orientation portion perpendicular to the shaft, and comprising ⅖ to ⅗ the width of the blades.

* * * * *